United States Patent [19]

Saunders et al.

[11] 3,934,509

[45] Jan. 27, 1976

[54] MOUNTING MEANS FOR A PRINTING PLATE

[75] Inventors: Philip G. Saunders; Jack R. Simpson, both of Toledo, Ohio

[73] Assignee: Container Graphics Corporation, Toledo, Ohio

[22] Filed: Apr. 8, 1974

[21] Appl. No.: 458,910

[52] U.S. Cl. ..... 101/415.1; 24/17 A; 24/73 A; 24/265 BH

[51] Int. Cl.[2] ..... B41F 27/06; B65D 67/02

[58] Field of Search..... 101/415.1; 24/73 R, 73 A, 24/81 AG, 81 A, DIG. 4, 84 A, 85 A, 86 A, 31 L, 17 A, 81 PE, 81 DM, 20 EE, 73 CC, 73 D, 73 ES, 73 LA, 73 P, 73 PF, 265 A, 265 BH, 224 PS, 230.5 BA, 16 PB

[56] References Cited

UNITED STATES PATENTS

| | | | |
|---|---|---|---|
| 338,896 | 3/1886 | Wegmann | 24/31 L |
| 427,366 | 5/1890 | Robischung | 101/415.1 |
| 1,196,216 | 8/1916 | Doredant et al. | 24/73 ES |
| 1,253,658 | 1/1918 | Wilson | 24/73 ES |
| 1,333,102 | 3/1920 | Dietsche | 24/17 A |
| 1,411,930 | 4/1922 | Peterson | 24/17 A |
| 1,422,286 | 7/1922 | Majors | 101/115 X |
| 1,690,694 | 11/1928 | Nissen | 24/73 A |
| 1,831,618 | 11/1931 | Alland | 24/73 A |
| 2,094,210 | 9/1937 | Graben | 24/DIG. 4 |
| 2,808,675 | 10/1957 | Sharp | 24/265 BH |
| 3,276,088 | 10/1966 | Block et al. | 24/265 A |
| 3,295,443 | 1/1967 | Devon | 101/415.1 X |
| 3,403,427 | 10/1968 | Asseo et al. | 24/73 R |
| 3,739,429 | 6/1973 | Kohke | 24/16 PB |

*Primary Examiner*—Edgar S. Burr
*Assistant Examiner*—Paul J. Hirsch
*Attorney, Agent, or Firm*—Allen D. Gutchess, Jr.

[57] ABSTRACT

Mounting means for mounting a printing plate on a printing plate cylinder are provided. The mounting means include a mounting member or sheet made of a plastic sheet material which is solvent resistant, strong, dimensionally stable, conforms truly to the printing plate cylinder, and is of uniform thickness. The leading edge of the mounting member is turned back to form a structurally-integral lip thereon which is readily connected to a mounting flange on the printing plate cylinder. The mounting means further include a mounting strap which affixes the mounting member on the cylinder with the lip engaged with the flange of the cylinder. The mounting strap has a first portion received in an opening of the mounting member and a second portion having an integral lip which engages another mounting flange of the printing cylinder. A resilient band connects the first and second portions and is in tension when the first portion is connected to the mounting member and the second portion is connected to the cylinder flange. Preferably two resilient bands are used so that one will still hold the mounting member if the other breaks. The two mounting portions of the mounting strap preferably are made of plastic sheet material so that if they become loose, they will not damage the inking rolls employed with the cylinder.

5 Claims, 7 Drawing Figures

FIG. 1
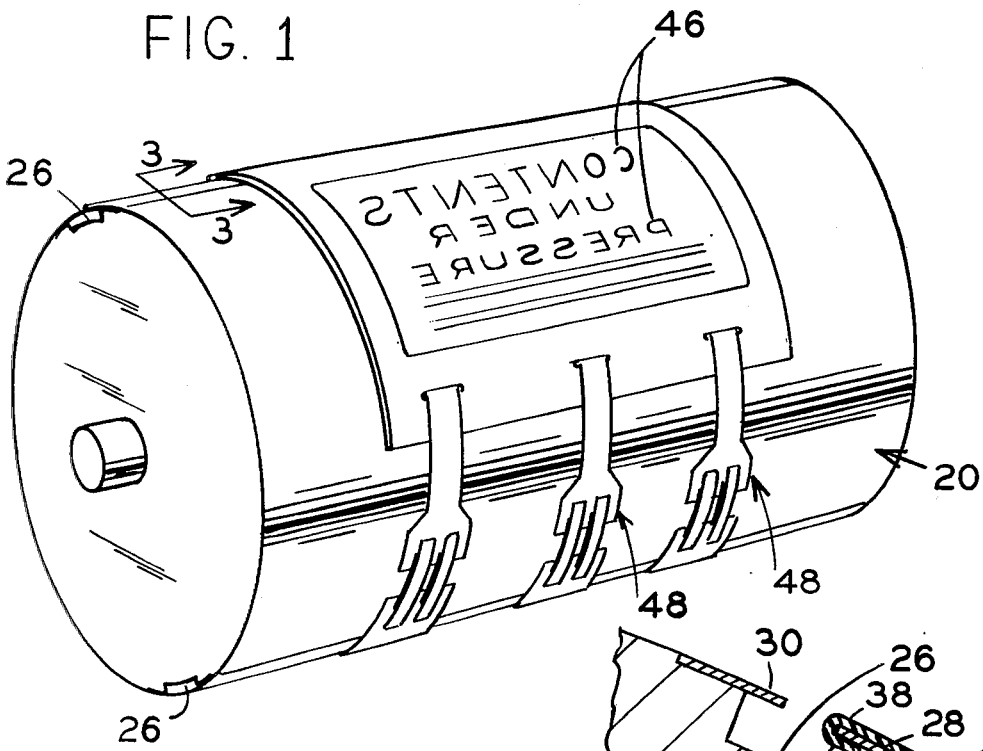
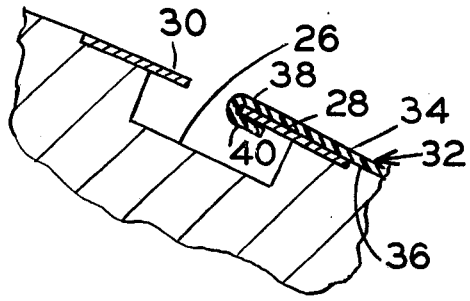
FIG. 3
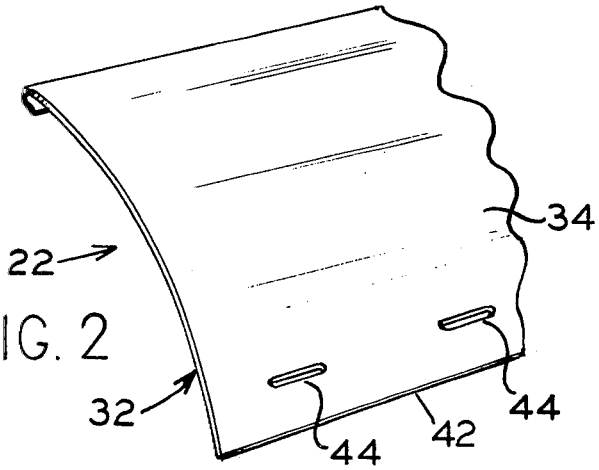
FIG. 2

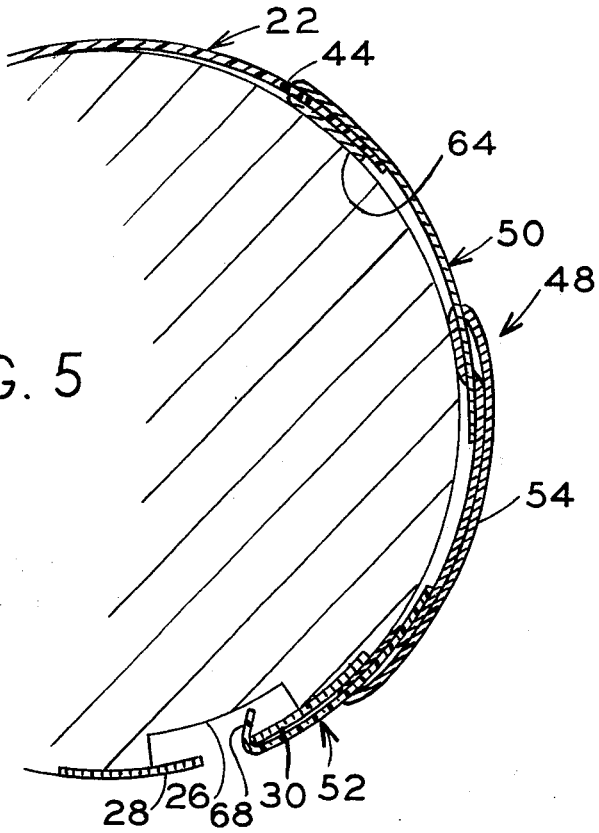
FIG. 5
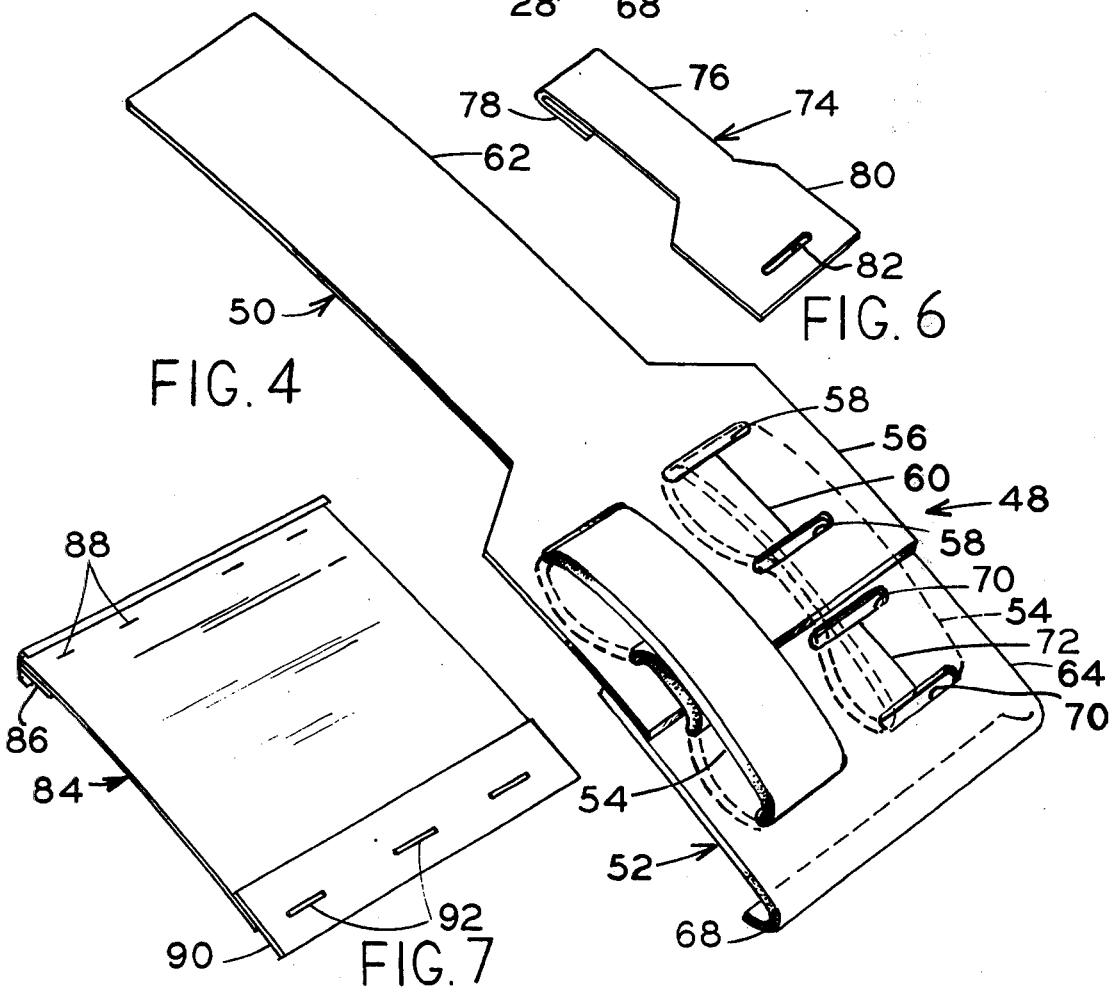
FIG. 6
FIG. 4
FIG. 7

MOUNTING MEANS FOR A PRINTING PLATE

This invention relates to mounting means for mounting printing plates on printing plate cylinders.

Mounting means for mounting printing plates on cylinders heretofore have consisted basically of a mounting member or sheet on which the printing plate is affixed, and straps for holding the mounting sheet and printing plate on the printing plate cylinder. The mounting sheets heretofore used for printing plates have been made of rubber-impregnated cloth or of a paper-plastic laminate. In order to produce mounting lips on such mounting sheets, separate elongate lip or flange members have had to be stapled or sewn to edges of the sheet. A lip member of this nature required separate parts which had to be inventoried, stored, cut to length, and affixed in separate operations. Such lip members also had a tendency to work loose from time-to-time during the printing operation, requiring a shut down thereof.

A printing plate mounting member or sheet, constituting part of the mounting means according to the invention, is made of a plastic sheet material which is solvent resistant, strong, dimensionally stable, conforms truly to the printing plate cylinder, and is of precise, uniform thickness. A mounting lip is provided on the leading edge of the mounting member which is formed by sequentially heating and bending the leading edge of the member, and is structurally integral therewith. The structurally-integral lip is low in cost to produce and is strong, not tending to pull away or loosen as separate lips heretofore employed have done. The integral lip also eliminates extra parts and extra labor required to cut separate lip members to proper lengths and to affix them to the mounting sheet.

The mounting means according to the invention also include an improved mounting strap for the mounting sheet. Mounting straps heretofore have employed metal clips or hooks connected by a rubber strap. If the strap broke, the metal hooks would often become caught between the mounting plate cylinder and an inking cylinder or roll employed therewith, damaging the surface of the inking cylinder and rendering it unsuitable for further use.

The mounting strap in accordance with the invention is made of two plastic portions preferably connected by two resilient bands. If either band should break, the other will hold the mounting strap and the printing plate mounting sheet in place until the equipment can be shut down to replace the broken band. Further, the plastic portions of the mounting strap cannot cause damage to the inking cylinder or other portions of the printing apparatus. One portion of the new mounting strap has an elongate strip which is inserted into an opening in the mounting sheet and bent back on itself at the desired length, so that one mounting strap can be used for almost any application. In contrast, heretofore, the mounting straps were made in a number of different sizes, each only being suitable for a relatively short range of lengths, e.g. 13–16 inches. The new mounting strap is also considerably less expensive than those heretofore known.

It is, therefore, a principal object of the invention to provide improved mounting means for mounting a printing plate on a printing plate cylinder.

Another object of the invention is to provide an improved mounting sheet and mounting strap for mounting a printing plate on a printing plate cylinder.

A further object of the invention is to provide an improved mounting strap employing two resilient bands, either of which will hold a mounting sheet in place in the event the other breaks.

Yet another object of the invention is to provide an improved mounting strap having end connecting portions made entirely of plastic material.

Still a further object of the invention is to provide an improved mounting strap which is suitable for substantially any length required.

Many other objects and advantages of the invention will be apparent from the following detailed description of a preferred embodiment thereof, reference being made to the accompanying drawings, in which:

FIG. 1 is a view in perspective of a printing plate cylinder having a mounting member or sheet fastened thereto by mounting straps in accordance with the invention;

FIG. 2 is an enlarged, fragmentary view in perspective of the mounting sheet of FIG. 1;

FIG. 3 is a detailed, enlarged view in transverse cross section taken along the line 3—3 of FIG. 1;

FIG. 4 is an enlarged view in perspective of a mounting strap in accordance with the invention;

FIG. 5 is an enlarged, detailed view in transverse cross section taken through part of the printing plate cylinder, the mounting sheet, and one of the mounting straps of FIG. 1;

FIG. 6 is a view in perspective of a mounting strap extension useable with the mounting strap of FIG. 4; and FIG. 7 is a view in perspective of a known mounting sheet having a connecting strip affixed thereto.

Referring to the drawings, and particularly to FIG. 1, a printing plate cylinder 20 has a mounting member or sheet 22 fastened thereto, with a rubber printing plate 24 mounted thereon. These assembled components are used in a rotary printing press to print indicia on sheet material, such as corrugated board, which is directed between the printing plate cylinder 20 and another roll located thereunder (not shown). One or more inking cylinders or rolls are also associated with the printing plate cylinder 20 to apply ink to the printing plate 24. Typically, the cylinder 20 has longitudinally-extending channels or grooves 26 having first mounting flanges 28 and second mounting flanges 30 affixed to the cylinder in a flush manner with the flanges extending toward one another over portions of the channels 26.

Referring particularly to FIG. 2, the mounting member 22 comprises a single sheet 32 of plastic material of predetermined size and shape. The plastic material can be a general purpose, calendered, rigid, polyvinyl chloride sheeting which is commercially available. The material can be obtained, for example, from Tenneco Chemicals, Inc. under the designation V.C.H. 8001. Typically, the sheet is 0.030 inch thick with a variation of only ± 0.001 inch. However, the sheet also is available in a thickness of 0.050 inch which is suitable for the invention, a thickness range of 0.020 to 0.070 inch being satisfactory. The sheet 32 has a front, convex surface 34 and a back, concave surface 36 and can be formed with the cruve or can simply assume the curve of the cylinder 20 when mounted thereon.

A leading edge portion 38 of the mounting member has a structurally-integral lip or flange 40 connected thereto. The lip 40 is generally parallel to the sheet 32 and is spaced therefrom a distance substantially equal to the thickness of the first flange 28. A trailing edge portion 42 of the mounting member 22 has spaced openings 44 for mounting the member on the cylinder 20 through the use of straps. The sheet 32 is sufficiently strong that the openings 44 can be employed therein without the necessity of using grommets therewith as has been the case with mounting sheets heretofore known.

The printing plate 24 can be of molded rubber with suitalbe indicia indicated at 46 in FIG. 1 formed thereon. The printing plate 24 can be mounted on the outer surface 34 of the mounting member 22 by means of adhesive or other suitable means.

Referring to FIGS. 4 and 5, the mounting member 22 is mounted on the printing plate cylinder 20 by means of mounting straps 48. Each of the mounting straps 48 includes a first portion 50 which connects to the mounting member 22 and a second portion 52 which connects to the second mounting flange 30 associated with the channel 26. The first and second portions 50 and 52 are connected by two resilient or rubber bands 54.

The first mounting strap portion 50 is made of a thin, plastic material which can be similar to that used for the mounting member 22 but is preferably thinner so that it will not extend too far outwardly from the cylinder 20 and possibly pick up ink from the inking roll. The portion 50 includes an enlarged end 56 having two pair of slots 58 connected by a slit 60 by means of which an end of each of the bands 54 can be pushed through so as to extend through both of the slots 58, as shown in FIG. 4. The first portion 50 of the mounting strap also includes a long strip 62 having a width less than the lengths of the openings 44 in the mounting member 22. To connect the first portion 50 with the mounting member 22, the strip 62 is inserted through the opening 44 with an end 64 bent back on itself, as shown in FIG. 5. The extent of the folding back of the strip 62 is determined by the particular application, the length being controlled such that the second portion 52 of the mounting strap 48 will engage the mounting flange 30 of the cylinder 20 with the bands 54 being under tension and with the two portions 50 and 52 being spaced apart, as shown in FIGS. 1 and 5. After the bent-back portion 64 is straightened, the strip 62 can subsequently be bent or folded back at the same or other location for a different application. The strip 62 can be bent a large number of times without breaking due to the nature of the plastic material of which it is made. Thus, one of the mounting straps 48 can be used for virtually every application so that the requirement that a number of mounting straps of different lengths be purchased and stored is eliminated.

The second portion 52 of the mounting strap 48 includes a wide, plate-like portion 66 and a structurally-integral lip 68 which can fit over the mounting flange 30. The plate-like portion 66 has two pairs of slots 70 therein connected by a slit 72 to receive an end of each of the bands 54. The portion 52 is thicker than the portion 50 to provide adequate strength for the lip 68.

In the event that the length of the strip 62 of the first portion 50 of the mounting strap 48 is insufficient for a particular application, a mounting strap extension indicated at 74 in FIG. 6 can be employed. The extension 74 includes a strip 76 having a portion 78 folded back as desired to any required length. The extension also includes an enlarged end 80 having an opening 82 therein. In use, the strip 76 is inserted in the opening 44 of the mounting member 22 and folded back and the strip 62 of the mounting strap 48 is then inserted through the opening 82 and folded under at the desired point.

The mounting strap 48 can also be used with the older type mounting member or sheet as shown in FIG. 7. In this instance, a mounting member or sheet 84 is made of an impregnated fabric material and has s separate plastic lip 86 suitably affixed thereto, as by staples 88. The lip 86 is intended to cooperate with the flange 28 of the cylinder 20 in the same manner as the integral lip 40 of the mounting member 22. To provide the openings for the strip 62 of the first portion 50 of the mounting strap 48, a separate plastic connecting strip 90 is employed. This strip has openings 92 therein similar to the openings 44 of the mounting member 22 and the strip 90 is affixed to the trailing edge of the mounting member 84 by stitching and/or adhesive. The strips 62 are then inserted into the openings 92 and bent back in a manner similar to that shown in FIG. 5.

From the above, it will be seen that the mounting means for a printing plate in accordance with the invention has a number of advantages. All of the parts are plastic including the portions 50 and 52 of the mounting strap 48 so that no damage can result to the inking cylinder in the event the tension bands break and the printing plate comes off the printing plate cylinder. The use of the two resilient bands 54 also enables the operator to stop the operation of the printing press in the event one of the two bands should fail, with the other band still holding the mounting member 22 and the printing plate 24 in position. The foldable strip 62 of the first portion 50 enables a single length of mounting strap to be employed for almost any application, thus reducing inventories and related costs greatly. The extension 74 enables the same mounting strap 48 to be used in the rare instance where longer straps might be required. The mounting strap 48 is also less expensive than those heretofore used. The mounting strap 48 can also be employed with the older type mounting members 84 by use of the plastic connecting strip 90.

Various modifications of the above-described embodiment of the invention will be apparent to those skilled in the art and it is to be understood that such modifications can be made without departing from the scope of the invention, if they are within the spirit and the tenor of the accompanying claims.

We claim:

1. Apparatus for printing indicia on surfaces, said apparatus comprising a printing plate cylinder having at least two mounting flanges affixed thereto, a mounting sheet having a downwardly-turned lip along one edge thereof engaged with one of said mounting flanges, said mounting sheet also having a plurality of openings formed along an edge of said sheet opposite the edge having said lip, a printing plate mounted on said mounting sheet between said lip and said openings, and a mounting strap affixing said mounting sheet on said cylinder with said lip engaged with one of said mounting flanges, said mounting strap having a first portion received in one of said mounting sheet openings and having a second portion with a lip engagable with another of said mounting flanges of said cylinder, and resilient means connecting said two strap portions and being in tension when said first portion is connected to said mounting sheet and said second portion is connected to the mounting flange, said first portion of said mounting strap having an elongate strip of a width less than the width of one of said mounting sheet openings, a portion of said elongate strip being received through said one mounting sheet opening with said strip portion folded back between the remaining portion of said elongate strip and the surface of said printing plate cylinder, said elongate strip being made of a plastic material which can be folded by hand back on itself repeatedly at substantially any location along its length, said elongate strip being sufficiently rigid to hold said mounting sheet on said printing plate cylinder when folded back and said resilient means is under tension, said first portion of said mounting strap also having an enlarged portion at the end of said elongate strip opposite said elongate strip portion which is folded back, said enlarged portion having means for receiving and holding said resilient means connected with said second portion of said mounting strap.

2. Apparatus according to claim 1 characterized by said elongate strip having a thickness between 0.020 inch and 0.070 inch.

3. Apparatus according to claim 1 characterized by said resilient receiving and holding means comprising two sets of two slots each, said resilient means comprising two elongate endless resilient bands.

4. Apparatus according to claim 3 characterized by said second portion of said mounting strap having two sets of two slots each receiving portions of said bands which are spaced from said first portion.

5. Apparatus according to claim 1 characterized by said resilient means comprising two parallel resilient endless bands, each having spaced portions connected to said first and second portions of said strap.

* * * * *